US011480928B2

(12) United States Patent
Zanesco et al.

(10) Patent No.: US 11,480,928 B2
(45) Date of Patent: Oct. 25, 2022

(54) DEVICE FOR CONTROLLING AT LEAST ONE ELECTRONIC FUNCTION OF A PORTABLE OBJECT

(71) Applicant: ETA SA Manufacture Horlogère Suisse, Grenchen (CH)

(72) Inventors: Vittorio Zanesco, Neuchatel (CH); Raphaël Balmer, Vicques (CH); Damien Schmutz, Salavaux (CH); Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 248 days.

(21) Appl. No.: 16/762,983

(22) PCT Filed: Dec. 12, 2018

(86) PCT No.: PCT/EP2018/084617
§ 371 (c)(1),
(2) Date: May 11, 2020

(87) PCT Pub. No.: WO2019/129492
PCT Pub. Date: Jul. 4, 2019

(65) Prior Publication Data

US 2020/0333748 A1 Oct. 22, 2020

(30) Foreign Application Priority Data

Dec. 27, 2017 (EP) ..... 17210721

(51) Int. Cl.
*G04C 3/00* (2006.01)
*G04G 21/00* (2010.01)

(52) U.S. Cl.
CPC ..... *G04C 3/001* (2013.01); *G04G 21/00* (2013.01)

(58) Field of Classification Search
CPC ..... G04C 3/007; G04C 3/001; G04G 21/00; G04G 17/02; H01H 25/06; H01H 11/0056; H01R 43/16
See application file for complete search history.

(56) References Cited

U.S. PATENT DOCUMENTS 3,832,843 A * 9/1974 Wuthrich ..... G04C 21/20 968/447
3,975,896 A 8/1976 Kasama
(Continued)

FOREIGN PATENT DOCUMENTS

CN 1595573 A 3/2005
CN 102053560 A 5/2011
(Continued)

OTHER PUBLICATIONS

International Search report dated Feb. 12, 2019 in PCT/EP2016/084617 filed Dec. 12, 2018, citing documents AA-AC and AO-AP therein, 3 pages.
(Continued)

*Primary Examiner* — Edwin A. Leon
(74) *Attorney, Agent, or Firm* — Oblon, McClelland, Maier & Neustadt, L.L.P.

(57) ABSTRACT

A device for controlling at least one electronic function of a portable object, in particular a timepiece, includes a control stem capable of moving axially between at least a first and a second stable position, or between at least a stable position and an unstable position. The control device also includes an actuation element made from an electrically insulating material rigidly connected to the control stem, as well as at least one flexible electrical switching element provided to be mechanically actuated by the actuation element when the control stem is moved axially, the at least one flexible electrical switching element being capable of moving between a closing position in which the at least one flexible
(Continued)

electrical switching element closes an electrical circuit of the control device, and an opening position in which the at least one flexible electrical switching element opens the electrical circuit.

28 Claims, 3 Drawing Sheets

(56) References Cited

U.S. PATENT DOCUMENTS

| | | | | |
|---|---|---|---|---|
| 4,443,113 | A | 4/1984 | Fehrenbacher et al. | |
| 6,422,740 | B1 | 7/2002 | Leuenberger | |
| 6,836,108 | B1 | 12/2004 | Balko et al. | |
| 9,081,369 | B1 * | 7/2015 | Kaelin | G04B 29/00 |
| 10,551,798 | B1 * | 2/2020 | Bushnell | G04C 3/002 |
| 2005/0050718 | A1 | 3/2005 | Kaelin et al. | |
| 2011/0110199 | A1 * | 5/2011 | Girardin | G04B 27/04 368/190 |
| 2016/0357152 | A1 | 12/2016 | Hirayama | |

FOREIGN PATENT DOCUMENTS

| | | | |
|---|---|---|---|
| EP | 1 081 563 | A1 | 3/2001 |
| EP | 1 515 203 | A1 | 3/2005 |
| JP | 50-36273 | A | 7/1975 |
| JP | 50-96273 | A | 7/1975 |
| JP | 2005-84052 | A | 3/2005 |
| WO | WO 03/048871 | A3 | 6/2003 |

OTHER PUBLICATIONS

Combined Chinese Office Action and Search Report dated Mar. 3, 2021 in Chinese Patent Application No. 201880083799.1 (with English translation), citing documents AA, AB and AO through AQ therein, 16 pages.

Office Action dated May 6, 2021 in corresponding Japanese Patent Application No. 2020-527872 (with English Translation), citing documents AO and AP therein, 11 pages.

Combined Chinese Office Action and Search Report dated Oct. 20, 2021 in Chinese Patent Application No. 201880083799.1 (with English translation), citing document AO therein, 20 pages.

* cited by examiner

DEVICE FOR CONTROLLING AT LEAST ONE ELECTRONIC FUNCTION OF A PORTABLE OBJECT

TECHNICAL FIELD OF THE INVENTION

The present invention relates to a device for controlling at least one electronic function of a portable object, in particular a timepiece. The invention also relates to such a timepiece including this control device.

TECHNOLOGICAL BACKGROUND OF THE INVENTION

Portable objects such as a timepiece equipped with a device for controlling at least one electronic function implemented in such a portable object have been known for a long time.

These control devices generally comprise a control stem, the actuation of which allows control of the desired electronic function. For the correct execution of the desired electronic function, it is necessary to be able to detect the actuation of the control stem of the control device. Among the known solutions that allow detection of the actuation of a control stem, one widespread solution involves detecting the actuation of the control stem via the establishment of a galvanic contact by friction between a contact zone of this control stem and a corresponding electrical contact zone of an electrical circuit of this control device.

The solution described above has been known for a long time. It is simple to implement and not very costly. It has, however, certain disadvantages, examples of which include its lack of robustness and of reliability, which notably reduce its service life. Indeed, the repeated actuation of the control stem induces friction between the contact zone of this control stem and the corresponding contact zone of the electrical circuit. This repeated friction engenders wear of the control stem and/or of the electrical circuit over time, which inevitably causes an alteration in the quality of the galvanic contact between these two elements. After a certain time, the introduction of a control signal via the control stem becomes more and more random, or even impossible, and most often the only thing left to do is to throw away the defective portable object.

To overcome this disadvantage, it is known in the prior art to coat the contact zone of the control stem and the contact zone of the electrical circuit which rub against one another with a layer of a material resistant to abrasion, for example a metal material such as cadmium.

However, the application of a layer of a material resistant to abrasion onto the corresponding contact zones of the control stem and of the electrical circuit involves long and complex operations, which leads to an increase in the manufacturing costs of such control devices and, consequently, of the portable devices such as timepieces into which these portable devices are integrated. This is difficult to accept from an economic point of view, given that the portable objects equipped with such control devices are often cheap portable objects for which the production cost of the various components is a crucial factor.

Moreover, it is routine for the materials that have good properties of resistance to abrasion to be substances dangerous to humans, so that their use is often incompatible with small portable objects intended to be worn in contact with the skin of the users, and which can even be opened by the latter.

SUMMARY OF THE INVENTION

The goal of the present invention is to overcome the problems mentioned above as well as yet others by providing a robust and reliable control device comprising an actuation element that is carried by a control stem of the device, this actuation element being capable of cooperating via friction with an electrically conductive switching element in order to force this switching element to establish a galvanic contact with a contact pad of an electrical circuit with a view to ensuring a closing of this electrical circuit.

For this purpose, the object of the present invention is a device for controlling at least one electronic function of a portable object, in particular a timepiece, comprising a control stem capable of moving axially between at least a first and a second stable position, or between at least a first stable position and a second unstable position, the control device also comprising an actuation element rigidly connected to the control stem, as well as at least one flexible electrical switching element provided to be mechanically actuated by the actuation element when the control stem is moved axially, said at least one flexible electrical switching element being capable of moving between a closing position in which said at least one flexible electrical switching element closes an electrical circuit of the control device, and an opening position in which said at least one flexible electrical switching element opens said electrical circuit.

In Other Embodiments:

- the actuation element comprises a position-indexing zone including a cam profile provided to participate in the indexing of the stable and unstable positions into which the control stem is brought during an axial movement;
- the control device comprises a positioning spring arranged to cooperate with the cam profile defined in the position-indexing zone of the actuation element in order to define each stable and unstable position of the control stem;
- the control device comprises at least one electrical contact stud provided to cooperate with said at least one flexible electrical switching element when the latter is moved into a closing position;
- said at least one electrical contact stud comprises an end that is connected to a contact pad of the electrical circuit of the control device;
- the control device comprises a mechanical fastening stud connecting said at least one flexible electrical switching element in a fixed manner to the electrical circuit of the control device;
- the cam profile is formed by at least one hollow provided to cooperate with the positioning spring of the control device in order to define the stable position of the control stem, and/or a slope provided to cooperate with the positioning spring in order to define the unstable position of the control stem;
- said at least one flexible electrical switching element is made in one piece and has the shape of a V with two branches that each comprise an electrical contact zone of said flexible electrical switching element;
- the control device includes two distinct flexible electrical switching elements that each comprise an electrical contact zone; and
- each flexible electrical switching element is capable of cooperating with a mechanical contact zone of the actuation element in order to place the corresponding electrical contact zone in contact with the corresponding electrical contact stud during the movement of this flexible electrical switching element into the closing position.

The invention also relates to a portable object, in particular a timepiece, comprising at least one such control device.

BRIEF DESCRIPTION OF THE DRAWINGS

Other features and advantages of the present invention will be clearer from the detailed description that follows of a plurality of embodiments, these embodiments being given for purely illustrative and non-limiting purposes in relation to the appended drawings in which.

DETAILED DESCRIPTION OF AN EMBODIMENT OF THE INVENTION

The present invention is based on the general inventive idea consisting in providing a device for controlling at least one electronic function of a portable object with small dimensions, for example a wristwatch, in which the zone in which an electrical switching element is mechanically actuated is distinct from the zone in which the electrical switching element makes electrical contact for the activation of the electronic function. As a result of these features, the zone of electrical contact is protected against any risk of wear related to the friction engendered in the mechanical contact zone.

Figure 1:
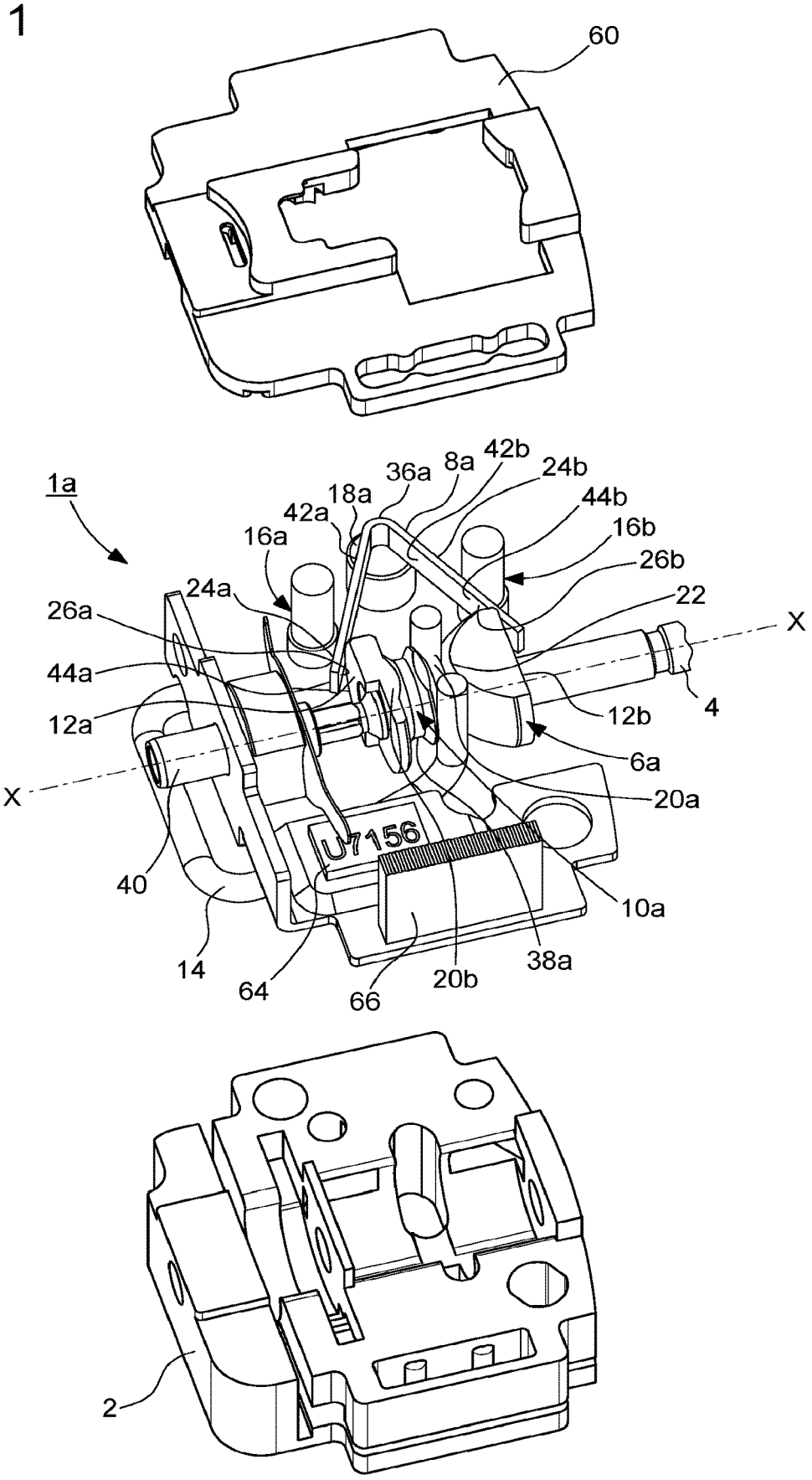
FIG. 1 is a perspective view of a device for controlling at least one electronic function of a portable object according to a first embodiment.

Designated overall by the general numerical reference 1*a*, a first embodiment of the control device according to the invention is illustrated in FIG. 1. This control device 1*a*, arranged to control at least one electronic function of a portable object 54 such as, in a non-limiting manner, a timepiece, comprises a lower frame 2 that acts as a cradle for a control stem 4. This control stem 4 is capable of moving axially from back to front and from front to back to control at least one electronic function of the portable object 54 in a robust and reliable manner.

In the following description, the back to front direction is a rectilinear direction that extends from an actuation crown 50 located outside the portable object 54 towards the inside of this portable object 54 in which the control device 1*a*, 1*b* is housed. This direction extends horizontally along the longitudinal axis of symmetry X-X of the control stem 4, perpendicularly to a middle 56 of the portable object 54. Thus, the control stem 4 is pushed from the back towards the front, and is pulled from the front towards the back. Moreover, the vertical direction z is a direction that extends perpendicularly to a bottom 58 of the portable object 54.

To allow the control of at least one electronic function of the portable object 54, the control device 1*a* comprises first of all an actuation element 6*a* which can be chosen to be made in one piece with the control stem 4 or fastened onto the latter. This actuation element 6*a* has at least one mechanical contact zone 12*a*, 12*b* by which it is in contact with an electrically conductive electrical switching element 8*a*. This actuation element 6*a* is arranged to actuate the electrical switching element 8*a* and allow the latter to establish a galvanic contact between an electrical contact zone of this electrical switching element 8*a* and a contact stud of an electrical circuit in order to ensure the closing of this electrical circuit. Thus, in the control device 1*a* according to the invention, the zone 12*a*, 12*b* of mechanical contact between the actuation element 6*a* and the electrical switching element 8*a*, and the zone of electrical contact between the electrical switching element 8*a* and the contact stud of the electrical circuit are two distinct zones, so that the repeated friction between the actuation element 6*a* and the electrical switching element 8*a* does not have any influence on the quality of the galvanic contact between the electrical contact zone and the contact stud of the electrical circuit.

As already mentioned above, the control device 1*a* illustrated in FIG. 1 is intended to allow the control of at least one electronic function of the portable object 54 which is an object with small dimensions such as a timepiece, in particular a wristwatch. The lower frame 2 of this control device 1*a*, for example made from an electrically insulating material such as injected plastic, acts as a cradle for the control stem 4 which preferably but not in a limiting way has an elongated and substantially cylindrical shape, and which has a longitudinal axis of symmetry X-X. This control stem 4 is arranged to slide from front to back and from back to front along its longitudinal axis of symmetry X-X, and/or to rotate about this same longitudinal axis of symmetry X-X in the clockwise and anti-clockwise direction.

More precisely, the control stem 4 comprises a rear end 46 which is located outside of the portable object 54 once the control device 1*a* has been installed in the portable object 54, and which is provided to receive an actuation crown 50. This control stem 4 also comprises a front end 48 which is located inside the portable object 54 once the control device 1*a* is housed inside the latter. The control stem 4 is also equipped with a smooth bearing 40 which, via cooperation with a corresponding receiving surface of the lower frame 2, ensures the support and the axial guiding of this control stem 4. It is noted that to allow the passage of the control stem 4 and the installation of the control device 1*a* in the portable object 54, a hole 52 is made in the middle of the portable object 54.

In this control device 1*a*, the lower frame 2 forms a cradle which is provided to receive the control stem 4 of the control device 1*a*. In the control device 1*a*, the control stem 4 has a preferably elongated and substantially cylindrical shape and extends along its longitudinal axis of symmetry X-X. The front end 48 of the control stem 4 has, for example, a square cross-section 12 that is capable of receiving the smooth bearing 40.

The actuation element 6*a* which can be made in one piece with the control stem 4 or be rigidly mounted onto this control stem 4 is capable of being driven in a movement of translation or of pivoting relative to the lower frame 2 when the control stem 4 is moved axially, or pivoted, respectfully, relative to this lower frame 2. In the case in which the actuation element 6*a* is a part added onto the control stem 4, it is preferably made from an electrically insulating material, that is to say a material that allows prevention of the passage of an electrical current into the control stem 4 onto which it is mounted when this actuation element 6*a* is placed in contact with an electrically conductive electrical component. For example, this actuation element 6*a* can be made of plastic.

Located in the lower frame 2 inside the control device 1*a*, the actuation element 6*a* is as a preferred but non-limiting example in the form of a ring having a circular transverse cross-section. This actuation element 6*a* comprises a peripheral wall and front and rear faces. The peripheral wall comprises a position-indexing zone 10*a* provided with a cam profile for example consisting of two hollows 20*a* and 20*b* separated from one another by a crest 38*a* which protrudes, the hollow 20*a* being extended by a sloped profile 22, for example of the truncated-cone type, which flares out towards the rear end 46 of the control stem 4. The two hollows 20*a* and 20*b* are for example circular grooves centred on the longitudinal axis of symmetry X-X of the control stem 4. It is noted that this cam profile comprises as many hollows as the number of stable positions in which the control stem 4 can be indexed in the control device 1*a*. Likewise, the cam profile comprises a number of slopes identical to the number of unstable positions into which the control stem 4 can be brought.

The cam profile formed by one or more hollows 20*a*, 20*b* and/or slope 22 of the position-indexing zone 10*a* of the actuation element 6*a* allows, via cooperation with the ends 34 of the rods 28 of a positioning spring 14, to define the stable and/or unstable position(s) in which the control stem 4 is capable of being located when the user moves it axially from back to front or from front to back.

More precisely, the positioning spring 14 has the overall shape of a U with two arms 30 that extend in a horizontal plane and which are connected to each other by a base 32. At their free end, the two arms 30 are extended by two substantially rectilinear upright rods 28. The positioning spring 14 is intended to be mounted in the control device 1*a* via the bottom of the lower frame 2, so that the ends 34 of the rods 28 protrude at the cam profile of the position-indexing zone 10*a* of the actuation element 6*a*.

The front and/or rear faces of the actuation element 6*a* define the mechanical contact zones 12*a* and 12*b* by which the actuation element 6*a* is capable of cooperating with the electrical switching element 8*a* of the control device 1*a*. More precisely, this electrical switching element 8*a* is a component of the "switch" type of an electrical circuit of the control device 1*a*. This electrical switching element 8*a* is indeed capable of being mechanically controlled by the actuation element 6*a* when the control stem 4 is moved axially from back to front or from front to back in order to be brought into one of its stable or unstable positions. When this electrical switching element 8*a* is mechanically controlled by the actuation element 6*a*, it deforms elastically and moves alternatingly from an open position to a closed position of the electrical circuit of the control device 1*a*. For this purpose, this electrical switching element 8*a* comprises:

- a linking part 36*a* which connects it preferably in a fixed and/or rigid manner to this electrical circuit via a fastening stud 18*a* of the control device 1*a;*
- at least one, and in the example shown, two electrical contact zones 24*a*, 24*b* defined in the outer faces of this electrical switching element 8*a* and provided to come in contact with a first and a second contract stud 16*a*, 16*b* of the electrical circuit when this electrical switching element 8*a* is moved into the position for closing the electrical circuit, and
- at least one, and in the example shown, two mechanical contact zones 26*a*, 26*b* defined in the inner faces of this electrical switching element 8*a* and provided to cooperate with the mechanical contact zones 12*a*, 12*b* formed by the front and/or rear faces of the actuation element 6*a*, 6*b*.

It is noted that the electrical switching element 8*a* is for example a metal spring strip in the shape of a V as illustrated in FIG. 1.

It is understood that the fastening stud 18*a* and the first and second contact studs 16*a* and 16*b* are all three conductors of electricity and are arranged in the lower frame 2 of the control device 1*a*, and that they each comprise an end that is connected to a contact pad provided on the surface of a printed circuit, for example a sheet of a flexible printed circuit (not shown), above which the control device 1*a* is disposed. Advantageously, the electrical circuit which allows connection of the fastening stud 18*a* and the two contact studs 16*a*, 16*b* to each other is structured on the sheet of flexible printed circuit. It is also noted that the fastening stud 18*a* and the contact studs 16*a*, 16*b* can be helical contact springs, spring strips or other. The electrical circuit also comprises all the necessary electronic components such as a microcontroller 64 and an electrical connector 66 for example of the ZEBRA® type for the execution of the desired electronic function.

The control device 1*a* comprises an upper frame 60 which is provided to cover the lower frame 2. The meeting of these two lower 2 and upper 60 frames which each have for example an overall parallelepipedic shape defines the outer geometry of the control device 1*a*. These two frames 2, 60 comprise the housings and surfaces adapted to receiving the component elements of the present control device 1*a*.

In the first embodiment described above and illustrated in FIG. 1, the control device 1*a* is provided with a single electrical switching element 8*a*. This electrical switching element 8*a* is made in one piece and has the shape substantially of a V with first and second arms 44*a*, 44*b* connected to each other by a linking part 36*a*. This electrical switching element 8*a* comprises a linking part 36*a* at which these arms 44*a*, 44*b* are connected to each other and which ensures the fastening of the electrical switching element 8*a* onto the fastening stud 18*a* for example by gluing, welding or interlocking. The outer face 42*a* of the arms 44*a*, 44*b* of the V forms the first and second electrical contact zones 24*a*, 24*b* of the electrical switching element 8*a*, while the inner faces 42*b* of the free ends of the arms 44*a*, 44*b* of the V define the mechanical contact zones 26*a* and 26*b* provided to cooperate with the mechanical contact zones 12*a*, 12*b* of the actuation element 6*a*. It is understood that the arms 44*a*, 44*b* of the V of the electrical switching element 8*a* are maintained distant from each other by the actuation element 6*a* against the elastic return force of the spring material from which the electrical switching element 8*a* is made. Consequently, when the control stem 4 is for example pulled from front to back, the electrical contact between the first electrical contact zone 24*a* and the first contact stud 16*a* is broken, while the electrical contact between the second electrical contact zone 24*b* and the second contact stud 16*b* is established. Thus, the first electrical circuit between the first contact stud 16*a* and the fastening stud 18*a* is open, while the second electrical circuit between the fastening stud 18*a* and the second contact stud 16*b* is closed. The reverse of that which has just been described occurs when the control stem 4 is pushed from back to front.

It will be understood upon reading that which follows that the cooperation between the position-indexing zone 10*a* of the actuation element 6*a* and the stems 28 of the positioning spring 14 allow indexing of the position of the control stem 4 in a first stable position T1 from which this control stem 4 can be pushed towards the front into an unstable position T0 or pulled towards the back into a second stable position T2, these three unstable T0 and stable T1 and T2 positions each corresponding to the introduction of a distinct electrical control signal.

More precisely, in FIG. 1, the control stem 4 is in its stable position T1 from which it will be understood that it can be pushed towards the front into its unstable position T0, or be pulled towards the back into its stable position T2. Thus, the first stable position T1 of the control stem 4 corresponds to the position in which the ends 34 of the rods 28 of the positioning spring 14 protrude into the first hollow 20*a* of the position-indexing zone 10*a* defined in the actuation element 6*a*. In this first stable position T1, the electrical switching element 8*a* is in its rest position in which its mechanical contact zones 26*a*, 26*b* are in contact with and maintained distant from one another by the actuation element 6*a*, while its first and second electrical contact zones 24*a* and 24*b* are not in contact with the first and second contact studs 16*a* and 16*b*.

From this first stable position T1, the control stem 4 can be pushed forward into an unstable position T0. During this movement, the ends 34 of the rods 28 of the positioning spring 14 exit the first hollow 20*a* and follow the sloped profile 22 which progressively moves away from the longitudinal axis of symmetry X-X of the control stem 4. To force the ends 34 of the rods 28 of the positioning spring 14 to exit the first hollow 20*a* and move onto this sloped profile 22 while moving away from one another, the user must thus overcome a meaningful resisting stress. This resisting stress results from the fact that by following the sloped profile 22, the rods 28 of the positioning spring 14 move away from one another from their rest position and tend to desire to once again move closer to one another under the effect of their elastic return force opposed to the pushing force exerted by the user on the control stem 4. When the control stem 4 is moved from its stable position T1 towards its unstable position T0, the user must also overcome the resisting stress opposed by the electrical switching element 8*a*, the free end of the first arm 44*a* of which that bears on the first mechanical contact zone 12*a* of the actuation element 6*a* moves slightly away from its rest position when the user pushes on the control stem 4, and tends to once again desire to reoccupy this rest position under the effect of its elastic return force. In this unstable position T0 of the control stem 4, the first electrical contact zone 24*a* of the electrical switching element 8*a* is in contact with the first contact stud 16*a*, and thus closes the electrical circuit between this first contact stud 16*a* and the fastening stud 18*a*. The electrical current thus passes through the electrical switching element 8*a* from the first contact stud 16*a* to the fastening stud 18*a*, which allows detection of the position of closing the corresponding electrical circuit.

As soon as the user releases the pressure on the control stem 4, the rods 28 of the positioning spring 14 spontaneously go back down along the sloped profile 22, their ends 34 again being housed in the first hollow 20*a* of the position-indexing zone 10*a* of the actuation element 6*a*, forcing the control stem 4 to go back to its stable position T1. The first arm 44*a* of the electrical switching element 8*a* also goes back to its rest position and thus participates in the return movement of the control stem 4 into its stable position T1. The control stem 4 is thus automatically returned from its unstable position T0 to its first stable position T1.

From the stable position T1, it is possible to pull the control stem 4 backward into a second stable position T2. During this movement, the ends 34 of the rods 28 of the positioning spring 14 go while being elastically deformed from the first hollow 20*a* to the second hollow 20*b* by passing over the crest 38*a* separating them. At the same time, the electrical switching element 8*a*, the free end of the second arm 44*b* of which bears on the second mechanical contact zone 12*b* of the actuation element 6*a*, moves slightly away from its rest position when the user pulls on the control stem 4, and tends to once again desire to go back to this rest position under the effect of its elastic return force. In this stable position T2 of the control stem 4, the second electrical contact zone 24*b* of the electrical switching element 8*a* is in contact with the second contact stud 16*b*, and thus closes the electrical circuit between the fastening stud 18*a* and this second contact stud 16*b*. The electrical current thus passes through the electrical switching element 8*a* from the fastening stud 18*a* to the second contact stud 16*b*, which allows detection of the position of closing the corresponding electrical circuit.

Figure 2:
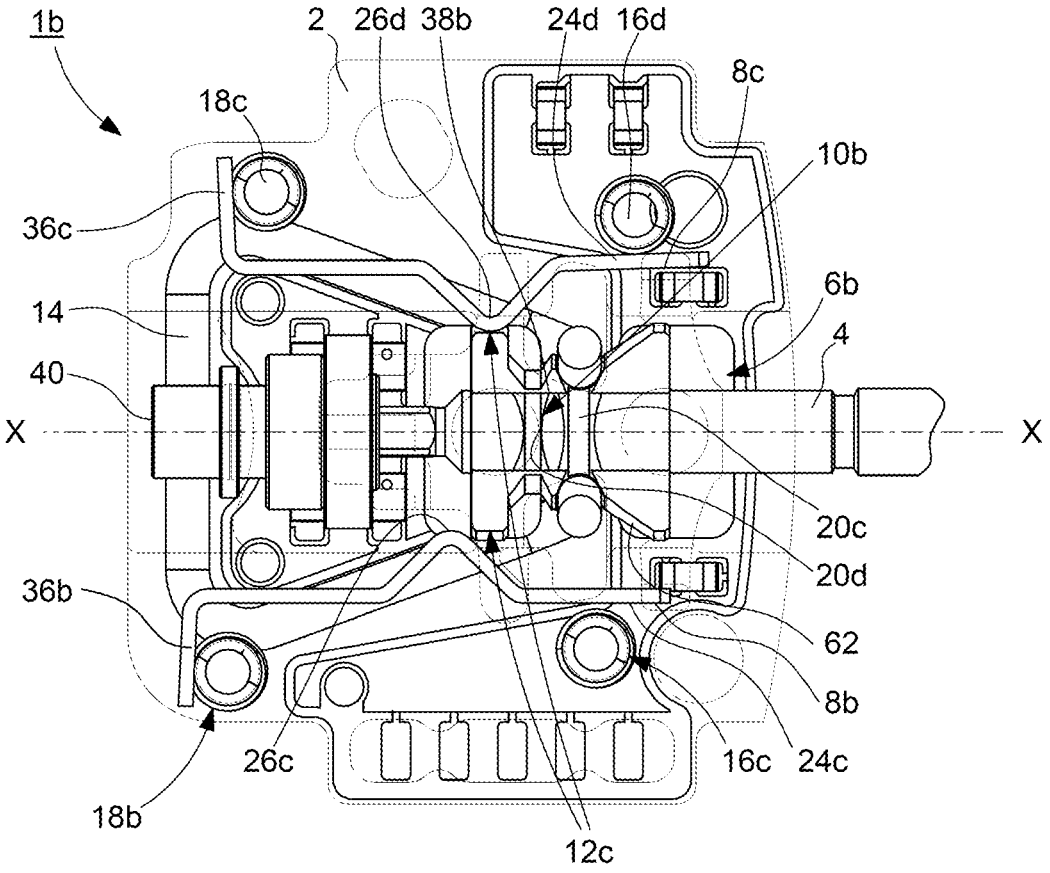
FIG. 2 is a transparent top view of a second embodiment of a device for controlling at least one electronic function of a portable object.
Figure 3:
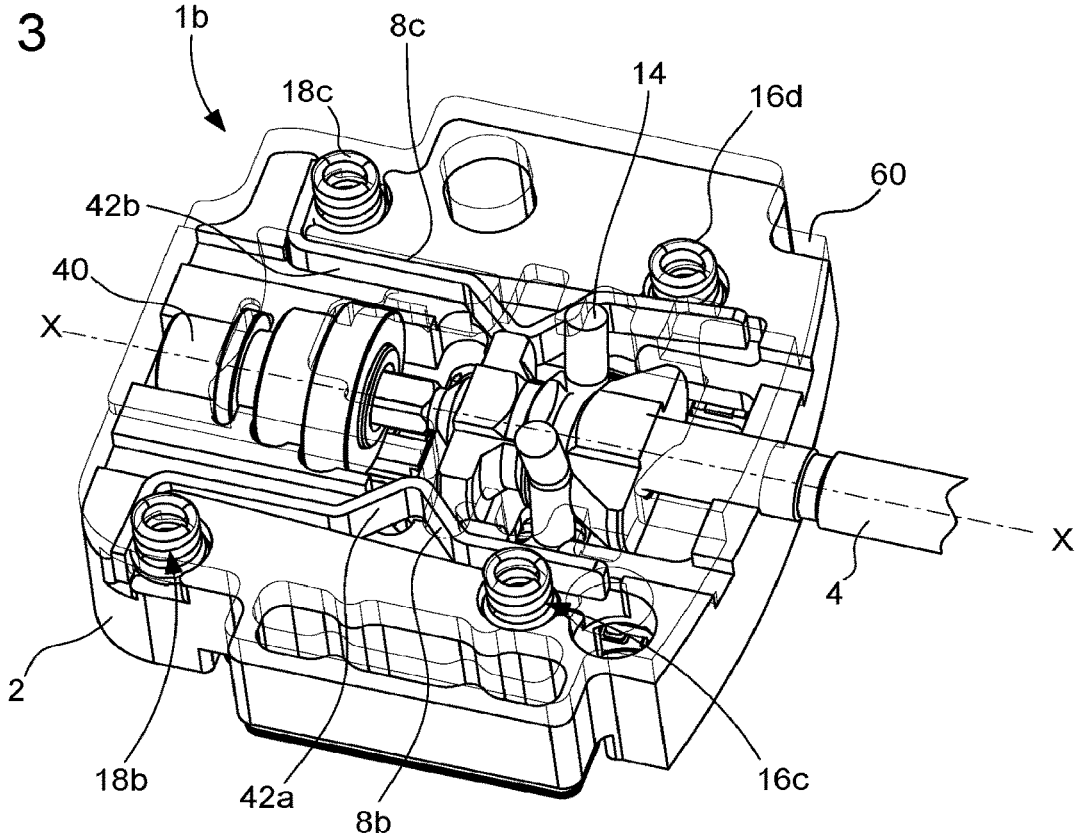
FIG. 3 is a transparent perspective view of the control device illustrated in FIG. 2.
Figure 4:
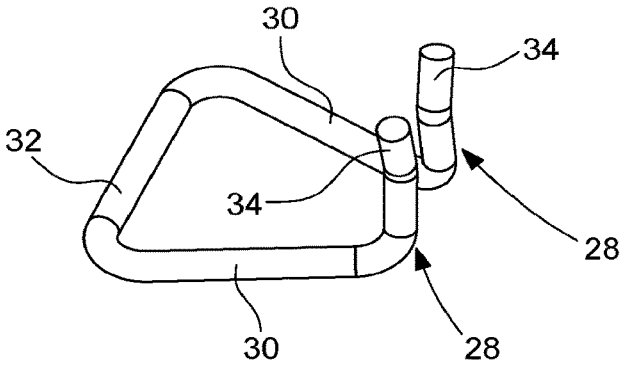
FIG. 4 is a perspective view of a positioning spring of the control device according to the first and second embodiments.
Figure 5:
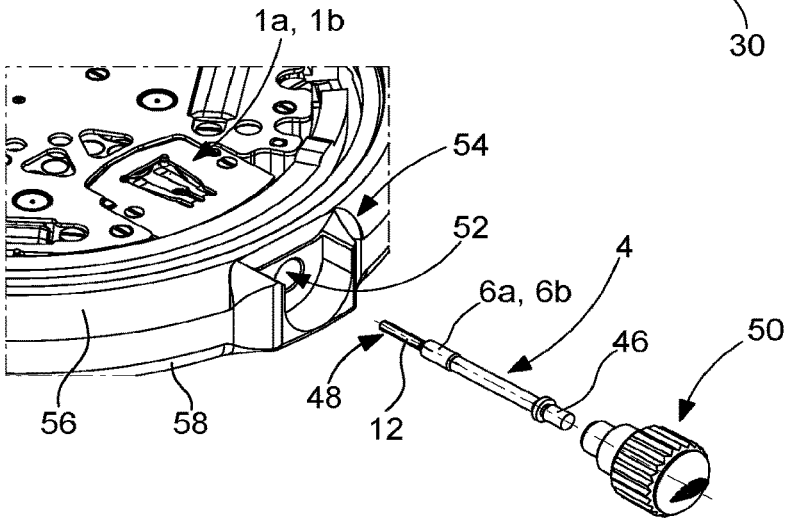
FIG. 5 is a schematic view of the portable object, here a timepiece, including the control device according to the first and second embodiments.

Designated as a whole by the general numerical reference 1*b*, a second embodiment of the control device according to the invention is illustrated in FIGS. 2 and 3. This control device 1*b* includes distinct first and second electrical switching elements 8*b* and 8*c*. The first end of each of these first and second electrical switching elements 8*b* and 8*c* comprises in its outer face 42*a* a first linking part 36*b* and a second linking part 36*c*, respectively, allowing to ensure the fastening, in particular by gluing, welding or interlocking, of these two electrical switching elements 8*b*, 8*c* onto a corresponding first and second fastening stud 18*b*, 18*c* of the control device 1*b*. As for the second end of the electrical switching elements 8*b* and 8*c*, it comprises a first and a second electrical contact zone 24*c*, 24*d*, respectively, arranged in the outer face 42*a* of the electrical switching elements 8*b*, 8*c*.

These first and second electrical switching elements 8*b*, 8*c* also comprise, between their first and second ends, a deformed part, for example a fold in the shape of a V, that forms in their inner face 42*b* a first and a second mechanical contact zone 26*c*, 26*d*, respectively. Thus, in the control device 1*b* according to the invention, the mechanical contact zones 26*c*, 26*d* between the actuation element 6*b* and the electrical switching elements 8*b* and 8*c*, and the electrical contact zones 24*c*, 24*d* between the electrical switching elements 8*c* and 8*d* and the contact studs 16*c* and 16*d* are zones distinct from one another, so that the repeated friction between the actuation element 6*b* and the electrical switching elements 8*b* and 8*c* does not have any influence on the quality of the galvanic contact between the electrical switching elements 8*b*, 8*c* and the contact studs 16*c*, 16*d*. It is also observed that the mechanical contact zones 26*c* and 26*d* of the first and second electrical switching elements 8*b* and 8*c* are not facing one another, so that when the actuation element 6*b* activates one of these electrical switching elements 8*b*, 8*c*, this does not necessarily cause the activation of the other electrical switching element.

In the control device 1*b*, the position-indexing zone 10*b* of the actuation element 6*b* comprises first and second hollows 20*c* and 20*d* separated by a crest 38*b*. The hollow 20*c* is continued by a sloped profile 62 that flares out towards the rear end of the control stem 4.

In addition in this control device 1*b*, the mechanical contact zone 12*c* of the actuation element 6*b* that must cooperate with the mechanical contact zones 26*c*, 26*d* of the first and second flexible electrical switching elements 8*b*, 8*c* during the axial movement of the control stem 4 is located in the front and rear faces as well as in a part of the peripheral wall of the actuation element 6*b*. It is noted that the cooperation between the mechanical contact zone 12*c* of the actuation element 6*b* and the mechanical contact zones 26*c*, 26*b* engenders a substantially pivoting movement of the first and second flexible electrical switching elements 8*b*, 8*c* about the stationary points formed by the fastening studs 18*b*, 18*c* and, in particular, the displacement of the electrical contact zones 24*c*, 24*d* defined in these flexible electrical switching element electrical switching elements 8*b*, 8*c*.

The control device 1*b* comprises two electrical circuits. The first of these electrical circuits consists in particular of the contact stud 16*c* and the fastening stud 18*b*, as well as the first electrical switching element 8*b*. As for the second electrical circuit, it consists in particular of the contact stud 16*d*, the fastening stud 18*c*, and the electrical switching element 8*c*.

It will be shown below that the cooperation between the position-indexing zone 10*b* of the actuation element 6*b* and the positioning spring 14 allows indexing of the position of the control stem 4 between stable T1 and T2 and unstable T0 positions.

In the second embodiment of the control device 1*b* illustrated in FIGS. 2 and 3, the control stem 4 can be pulled from its first stable position T1 towards the back into a second stable position T2 or pushed towards the front into a third unstable position T0. These three positions T0, T1 and T2 of the control stem 4 are indexed by cooperation between the position-indexing zone 10*b* and the positioning spring 14. More precisely, the stable position T1 corresponds to the position in which the ends 34 of the rods 28 of the positioning spring 14 protrude into the first hollow 20*c* of the position-indexing zone 10*b* defined in the actuation element 6*b*. In this position, the rods 28 of the positioning spring 14 as well as the first flexible electrical switching element 8*b* are in their rest position, that is to say a position in which they are not subjected to a constraining force. In this stable position T1, the first flexible electrical switching element 8*b* of the control device 1*b* occupies a position in which the first electrical circuit is open. In this position in which the first electrical circuit is open, the electrical contact zone 24*c* defined on the outer face 42*a* of the free end of this first flexible electrical switching element 8*b* is not in contact with the third corresponding contact stud 16*c* of the control device 1*b*. However, in the stable position T1 of the control stem 4, the second flexible electrical switching element 8*c* of the control device 1*b* occupies a position in which the second electrical circuit is closed. In this position in which the second electrical circuit is closed, the electrical contact zone 24*d* defined on the outer face 42*a* of the free end of this second flexible electrical switching element 8*c* is in contact with the fourth corresponding contact stud 16*d* of the control device 1*b*. Thus, the electrical current passes through the second flexible electrical switching element 8*c*, which allows detection of the closed position of the electrical contact between this second flexible electrical switching element 8*c* and the second contact stud 16*d*.

From the first stable position T1, it is possible to pull the control stem 4 backward into a second stable position T2. During this movement, the ends 34 of the rods 28 of the positioning spring 14 go while being elastically deformed from the first hollow 20*c* to the second hollow 20*d* by passing over the crest 38*b* separating them. Likewise, during this movement, the mechanical contact zone 12*c* of the actuation element 6*b* on which the second flexible electrical switching element 8*c* bears moves while rubbing against this flexible electrical switching element 8*c* until a point at which this second flexible electrical switching element 8*c* is no longer in contact with the actuation element 6*b* and goes back to its rest position under the effect of the elastic return forces. In this stable position T2 of the control stem 4, the second flexible electrical switching element 8*c* of the control device 1*b* occupies a position in which the second electrical circuit is open. In this position in which the second electrical circuit is open, the electrical contact zone 24*d* defined on the outer face 42*a* of the free end of this second flexible electrical switching element 8*c* is not in contact with the fourth corresponding contact stud 16*d* of the control device 1*b*. Moreover, in the second stable position T2 of the control stem 4, the position of the first flexible electrical switching element 8*b* remains unchanged. In this second stable position T2, the first flexible electrical switching element 8*b* of the control device 1*b* still occupies a position in which the first electrical circuit is open and the electrical contact zone 24*c* defined on the outer face 42*a* of the free end of this first flexible electrical switching element 8*b* is not in contact with the third corresponding contact stud 16*c* of the control device 1*b*.

From the first stable position T1, the control stem 4 can be pushed forward into a third unstable position T0. During this movement, the ends 34 of the rods 28 of the positioning spring 14 exit the first hollow 20*c* and follow the sloped profile 62, for example of the truncated-cone type, which progressively moves away from the longitudinal axis of symmetry X-X of the control stem 4. To force the ends 34 of the rods 28 of the positioning spring 14 to exit the first hollow 20*c* and move onto this sloped profile 62 while moving away from one another, the user must thus overcome a meaningful resisting stress. This resisting stress results from the fact that by following the sloped profile 62, the rods 28 of the positioning spring 14 move away from one another from their rest position and tend to desire to once again move closer to one another under the effect of their elastic return force opposed to the pushing force exerted by the user on the control stem 4. As soon as the user releases the pressure on the control stem 4, the rods 28 of the positioning spring 14 spontaneously go back down along the sloped profile 62, their ends 34 again being housed in the first hollow 20*c* of the position-indexing zone 10*b* of the actuation element 6*b*, forcing the control stem 4 to go back to its stable position T1. The control stem 4 is thus automatically returned from its unstable position T0 to its first stable position T1.

Likewise, during this movement, the mechanical contact zone 12*c* of the actuation element 6*b* moves while rubbing against the mechanical contact zone 26*d* of the second flexible electrical switching element 8*c* which bears on this mechanical contact zone 12*c* of the actuation element 6*b*, until a point at which this second flexible electrical switching element 8*b* is no longer in contact with the actuation element 6*b* and goes back to its rest position under the effect of the elastic return forces. In this unstable position T0 of the control stem 4, the second flexible electrical switching element 8*c* of the control device 1*b* occupies a position in which the second electrical circuit is open. In this position in which the second electrical circuit is open, the electrical contact zone 24*d* defined on the outer face 42*a* of the free end of this second flexible electrical switching element 8*c* is not in contact with the fourth corresponding contact stud 16*d* of the control device 1*b*. As for the first flexible electrical switching element 8*b*, it moves from its rest position and abuts against the third contact stud 16*c* at its electrical contact zone 24*c* when the ends 34 of the rod 28 of the positioning spring 14 are on the sloped profile 22. It is noted that, during this movement, the mechanical contact zone 12*c* of the actuation element 6*b* moves while rubbing against the mechanical contact zone 26*c* of the first flexible electrical switching element 8*b*. This movement engenders a deformation of this first flexible electrical switching element 8*b* sufficient to allow placement of its electrical contact zone 24*c* in contact with the third contact stud 16*c*. Thus, when the control stem 4 arrives in its unstable position T0, only the first flexible electrical switching element 8*b* is brought into a position of closing the first electrical circuit in which its electrical contact zone 24*c* defined on its outer face 42*a* is in contact with the third contact stud 16*c* of the control device 1*b*. Thus, the electrical current passes through the first flexible electrical switching element 8*b*, which allows detection of the closed position of the electrical contact between this first flexible electrical switching element 8*b* and the third contact stud 16*c*.

In this second embodiment, three electronic functions of the portable object 54 can thus be controlled by the control device 1*b* according to whether the control stem 4 is brought into one or the other of its three unstable T0 or stable T1, T2 positions:

- the first stable position T1 in which only the second flexible electrical switching element 8*c* is in contact with the corresponding contact stud 16*d* at its electrical contact zone 24*d*, so that the second electrical circuit is in a closed or switched state;
- the second stable position T2 in which none of the first and second flexible actuation elements 8*b*, 8*c* are in contact with the third or the fourth corresponding contact stud 16*c*, 16*d*, so that each of the first and second electrical circuits is in an open or non-switched state; and
- the unstable position T0 in which only the first flexible electrical switching element 8*b* is in contact with the corresponding contact stud 16*c* at its electrical contact zone 24*c*, so that the first electrical circuit is in a closed or switched state.

In an alternative of this second embodiment, an additional function of the portable object 54 can be controlled by the control device 1*b* when the control stem 4 is in a new stable or unstable position in which the first and second flexible electrical switching elements 8*b*, 8*c* are in contact with the third and fourth contact studs 16*c*, 16*d*, respectively, so that first and second electrical circuits are simultaneously in a closed or switched state.

It goes without saying that the present invention is not limited to the embodiments that have just been described, and that various simple modifications and alternatives are possible for a person skilled in the art without going beyond the context of the invention as defined by the appended claims. It is noted in particular that the actuation element and the control stem can both be electrically insulating, or the actuation element is electrically insulating, in which case the control stem can be insulating or electrically conductive, or the actuation element is electrically conductive, in which case the control stem does not conduct electricity.

NOMENCLATURE

1*a*, 1*b*. Control device
2. Frame
4. Control stem
6*a*, 6*b*. Actuation element
8*a*, 8*b*, 8*c*, 8*d*. Flexible electrical switching element
10*a*, 10*b*. Position-indexing zones
12*a*, 12*b*, 12*c*. Mechanical contact zones
14. Positioning spring
16*a*, 16*b*, 16*c*, 16*d*. Contact studs
18*a*, 18*b*, 18*c*. Fastening studs
20*a*, 20*b*, 20*c*, 20*d*. Hollows
22. Sloped profile
24*a*, 24*b*, 24*c*, 24*d*. Electrical contact zones
26*a*, 26*b*, 26*c*, 26*d*. Mechanical contact zones
28. Rod
30. Arm
32. Base
34. Ends of the rods
36*a*, 36*b*, 36*c*. Linking parts
38*a*, 38*b*, 38*c*. Crests
40. Smooth bearing
42*a*. outer face
42*b*. inner face
44*a*, 44*b*. First and second arms
46. Rear end
48. Front end
50. Actuation crown
52. Hole
54. Portable object
56. Middle
58. Bottom
60. Upper frame
62. Sloped profile
64. Microcontroller
66. Electrical connector

The invention claimed is:

1. A device for controlling at least one electronic function of a portable object, comprising:

a control stem capable of moving axially between at least a first and a second stable position, or between at least a stable position and an unstable position, an actuation element made from an electrically insulating material rigidly connected to the control stem, and at least one flexible electrical switching element provided to be mechanically actuated by the actuation element when the control stem is moved axially, said at least one flexible electrical switching element being capable of moving between a closing position in which said at least one flexible electrical switching element closes an electrical circuit of the control device and an opening position in which said at least one flexible electrical switching element opens said electrical circuit, at least one electrical contact stud being provided to cooperate with said at least one flexible electrical switching element when said at least one flexible electrical switching element is moved into the closing position, said at least one flexible electrical switching element being made in one piece and having a shape of a V with two branches that each comprise an electrical contact zone of said flexible electrical switching element.

2. The control device according to claim 1, wherein the actuation element comprises a position-indexing zone including a cam profile provided to participate in the indexing of the stable and unstable positions into which the control stem is brought during an axial movement.

3. The control device according to claim 2, comprising a positioning spring arranged to cooperate with the cam profile defined in the position-indexing zone of the actuation element in order to define each stable and unstable position of the control stem.

4. The control device according to claim 3, wherein the cam profile is formed by at least one of at least one hollow provided to cooperate with the positioning spring of the control device in order to define the stable position of the control stem and a slope provided to cooperate with the positioning spring in order to define the unstable position of the control stem.

5. The control device according to claim 3, comprising a mechanical fastening stud connecting said at least one flexible electrical switching element in a fixed manner to the electrical circuit of the control device.

6. The control device according to claim 5, wherein the cam profile is formed by at least one of at least one hollow provided to cooperate with the positioning spring of the control device in order to define the stable position of the control stem and a slope provided to cooperate with the positioning spring in order to define the unstable position of the control stem.

7. The control device according to claim 3, wherein said at least one electrical contact stud comprises an end that is connected to a contact pad of the electrical circuit of the control device.

8. The control device to claim 7, wherein the cam profile is formed by at least one of at least one hollow provided to cooperate with the positioning spring of the control device in order to define the stable position of the control stem and a slope provided to cooperate with the positioning spring in order to define the unstable position of the control stem.

9. The control device according to claim 7, comprising a mechanical fastening stud connecting said at least one flexible electrical switching element in a fixed manner to the electrical circuit of the control device.

10. The control device according to claim 9, wherein the cam profile is formed by at least one of at least one hollow provided to cooperate with the positioning spring of the control device in order to define the stable position of the control stem and a slope provided to cooperate with the positioning spring in order to define the unstable position of the control stem.

11. The control device according to claim 2, comprising a mechanical fastening stud connecting said at least one flexible electrical switching element in a fixed manner to the electrical circuit of the control device.

12. The control device according to claim 11, wherein the cam profile is formed by at least one of at least one hollow provided to cooperate with the positioning spring of the control device in order to define the stable position of the control stem and a slope provided to cooperate with the positioning spring in order to define the unstable position of the control stem.

13. The control device according to claim 2, wherein said at least one electrical contact stud comprises an end that is connected to a contact pad of the electrical circuit of the control device.

14. The control device according to claim 13, wherein the cam profile is formed by at least one of at least one hollow provided to cooperate with the positioning spring of the control device in order to define the stable position of the control stem and a slope provided to cooperate with the positioning spring in order to define the unstable position of the control stem.

15. The control device according to claim 13, comprising a mechanical fastening stud connecting said at least one flexible electrical switching element in a fixed manner to the electrical circuit of the control device.

16. The control device according to claim 15, wherein the cam profile is formed by at least one of at least one hollow provided to cooperate with the positioning spring of the control device in order to define the stable position of the control stem and a slope provided to cooperate with the positioning spring in order to define the unstable position of the control stem.

17. The control device according to claim 1, wherein said at least one electrical contact stud comprises an end that is connected to a contact pad of the electrical circuit of the control device.

18. The control device according to claim 17, wherein a cam profile is formed by at least one of at least one hollow provided to cooperate with the positioning spring of the control device in order to define the stable position of the control stem and a slope provided to cooperate with the positioning spring in order to define the unstable position of the control stem.

19. The control device according to claim 17, comprising a mechanical fastening stud connecting said at least one flexible electrical switching element in a fixed manner to the electrical circuit of the control device.

20. The control device according to claim 19, wherein a cam profile is formed by at least one of at least one hollow provided to cooperate with the positioning spring of the control device in order to define the stable position of the control stem and a slope provided to cooperate with the positioning spring in order to define the unstable position of the control stem.

21. The control device according to claim 1, comprising a mechanical fastening stud connecting said at least one flexible electrical switching element in a fixed manner to the electrical circuit of the control device.

22. The control device according to claim 21, wherein a cam profile is formed by at least one of at least one hollow provided to cooperate with the positioning spring of the control device in order to define the stable position of the control stem and a slope provided to cooperate with the positioning spring in order to define the unstable position of the control stem.

23. The control device according to claim 1, comprising two distinct flexible electrical switching elements that each comprise an electrical contact zone.

24. The control device according to claim 23, wherein each flexible electrical switching element is configured to cooperate with a mechanical contact zone of the actuation element in order to place the corresponding electrical contact zone in contact with the corresponding electrical contact stud during the movement of this flexible electrical switching element into the closing position.

25. A portable object comprising the at least one control device according to claim 1.

26. The control device according to claim 1, wherein:

the at least one electrical contact stud comprises separate first and second electrical contact studs; and said two branches are configured to respectively and alternately make contact with the first and second electrical contact studs at a respective one of the electrical contact zones of said flexible electrical switching element in correspondence with axial movement of the control stem.

27. The control device according to claim 1, comprising:

the at least one electrical contact stud comprising separate first and second electrical contact studs; and an electrical contact connected to a portion of the flexible electrical element joining the two branches, wherein a first one of the two branches makes electrical contact with the first electrical contact stud when the control stem is in the unstable position, and a second one of the two branches makes electrical contact with the second electrical contact stud when the control stem is in one of the first and second stable positions.

28. The control device according to claim 1, comprising:

an electrical contact to the electrical circuit connected to a portion of the flexible electrical element joining the two branches.

* * * * *